US008215324B1

(12) United States Patent
Kuo

(10) Patent No.: US 8,215,324 B1
(45) Date of Patent: Jul. 10, 2012

(54) CONTROL STRUCTURE FOR AUTOMATICALLY FOLDING AND UNFOLDING UMBRELLA

(76) Inventor: Shih-Shin Kuo, Hsinchu (TW)

( * ) Notice: Subject to any disclaimer, the term of this patent is extended or adjusted under 35 U.S.C. 154(b) by 0 days.

(21) Appl. No.: 13/008,856

(22) Filed: Jan. 18, 2011

(51) Int. Cl.
*A45B 25/16* (2006.01)

(52) U.S. Cl. ..... 135/24

(58) Field of Classification Search ..... 135/15.1, 135/22, 24, 25.4, 25.41, 20.3
See application file for complete search history.

(56) References Cited

U.S. PATENT DOCUMENTS

| | | | | |
|---|---|---|---|---|
| 7,798,160 | B2 * | 9/2010 | Chen | 135/24 |
| 7,971,595 | B1 * | 7/2011 | Ko | 135/24 |
| 2009/0133729 | A1 * | 5/2009 | Chong | 135/20.3 |
| 2010/0288317 | A1 * | 11/2010 | Huang | 135/24 |
| 2010/0319739 | A1 * | 12/2010 | Chong | 135/24 |
| 2011/0114142 | A1 * | 5/2011 | Cai | 135/22 |
| 2011/0192435 | A1 * | 8/2011 | Ko | 135/24 |
| 2011/0226295 | A1 * | 9/2011 | Lo | 135/24 |
| 2011/0232707 | A1 * | 9/2011 | Wu et al. | 135/22 |

* cited by examiner

*Primary Examiner* — Noah Chandler Hawk
(74) *Attorney, Agent, or Firm* — Leong C. Lei

(57) ABSTRACT

An improved control structure for automatically folding and unfolding umbrella is provided. The control structure contains a main body whose upper and lower halves are hollow with a support base in the middle. A control piece is installed in the upper hollow space for locking the nest when the umbrella is closed and for pushing away the bullet head when the umbrella is opened. A lever having a slant block at a top end is pivotally configured on the support base. An actuating piece is configured on top of the lever. In the lower hollow space of the main body, a one-way wheel with ratchets is installed and wound with a safety string. When the umbrella is closed, the lever is prepared to engage the ratchets whenever some mishap occurs. Therefore, the umbrella is safer to operate.

6 Claims, 4 Drawing Sheets

CONTROL STRUCTURE FOR AUTOMATICALLY FOLDING AND UNFOLDING UMBRELLA

TECHNICAL FIELD OF THE INVENTION

The present invention generally relates to a control structure for automatically folding and unfolding umbrella, and more particularly to such a control structure where a one-way wheel is employed to protect the safety of operator by preventing the umbrella from sudden opening during the closing operation.

DESCRIPTION OF THE PRIOR ART

A conventional control structure for an automatically folded and unfolded umbrella is disclosed in U.S. Pat. No. 6,684,893 B2. As described, the control structure is installed in the handle of the umbrella and mainly contains a hollow main body with a control piece inside. The control piece has a control rod configured to a side under the control piece. A push button is configured on the same side of the main body and is exposed out of the handle to control the operation of the shaft of the umbrella. A substantial problem with the conventional umbrella is that, when the umbrella is closed or folded as described above, a spring inside the shaft has to be compressed with significant force. If the operator is not careful, the compressed spring may abruptly expand to thrust the shaft, causing damage to the operator's hand or other body parts.

Therefore, a number of improvements have been proposed such as those taught by R.O.C. Taiwan Patent No. M358556 and P.R.C. Patent Application No. 200710009892.1 (Publication No. CN101438877A). However, these improvements are complicated structurally and component-wise, leading to difficulty in assembly and high production cost.

SUMMARY OF THE INVENTION

Therefore, an improved control structure for automatically folding and unfolding umbrella is provided herein. The gist of the present invention lies in the adoption of a safety mechanism. When an operator mistakenly releases the shaft during the umbrella's closing operation, the safety mechanism is locked and the shaft does not thrust by the expansion of an opening spring. An umbrella according to the present invention is therefore much safer to operate.

To achieve the objective, the control structure contains a main body whose upper and lower halves are hollow with a support base in the middle. A control piece is installed in the upper hollow space for locking the nest when the umbrella is closed and for pushing away the bullet head when the umbrella is opened. A lever having a slant block at a top end is pivotally configured on the support base. An actuating piece having arms and a through opening is configured on top of the lever. The opening has a slant inner surface corresponding to the slant block of the lever. In the lower hollow space of the main body, a one-way wheel with ratchets is installed and wound with a safety string. When the umbrella is closed, the lever is prepared to engage the ratchets whenever some mishap occurs. When the umbrella is successfully closed, the actuating piece engages the lever so that the lever is moved away from the ratchets and that the umbrella could be smoothly opened subsequently.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in anyway. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
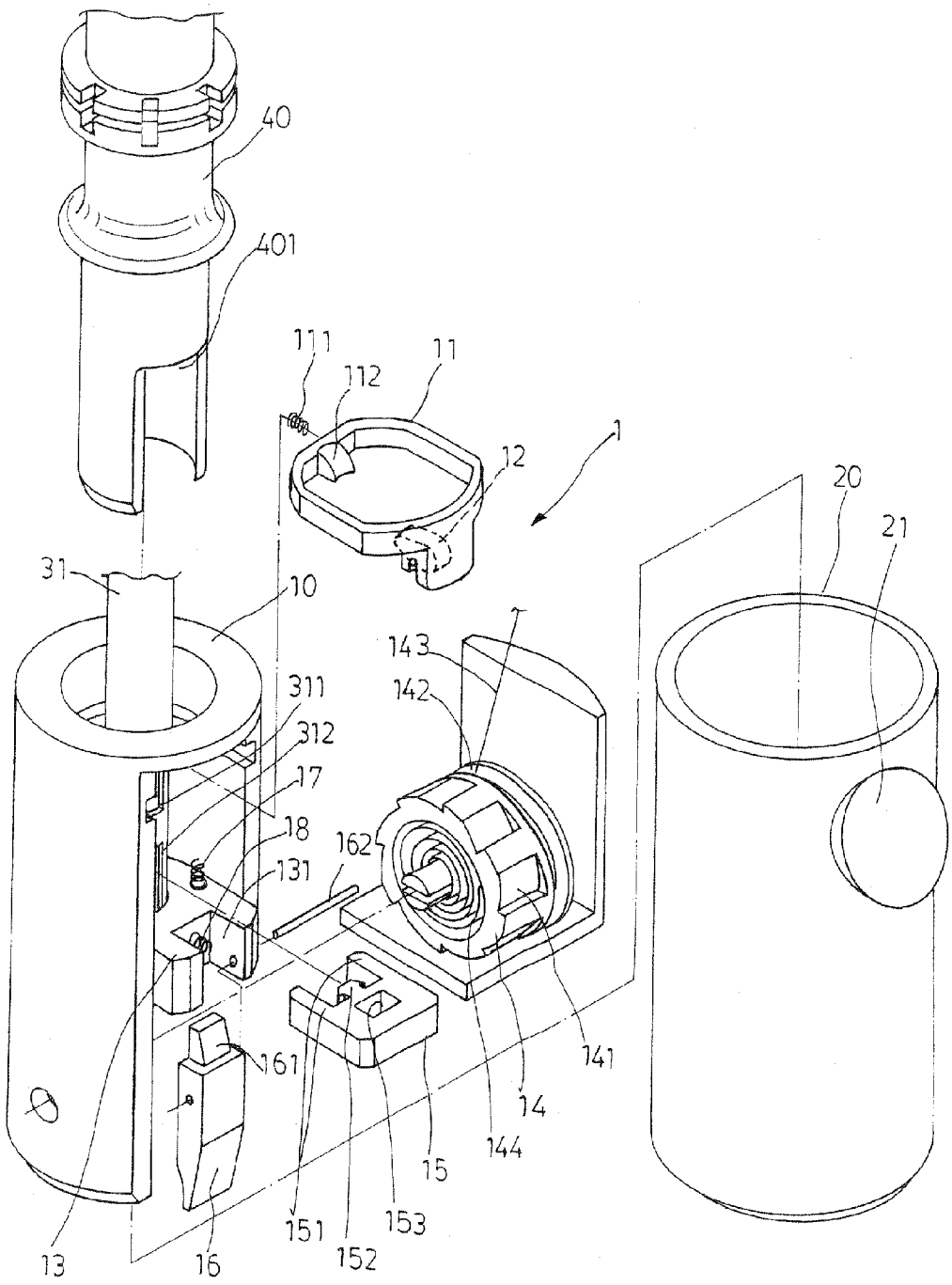
FIG. 1 is a perspective break-down diagram showing the various components of a control structure according to an embodiment of the present invention for an automatic umbrella.
Figure 2:
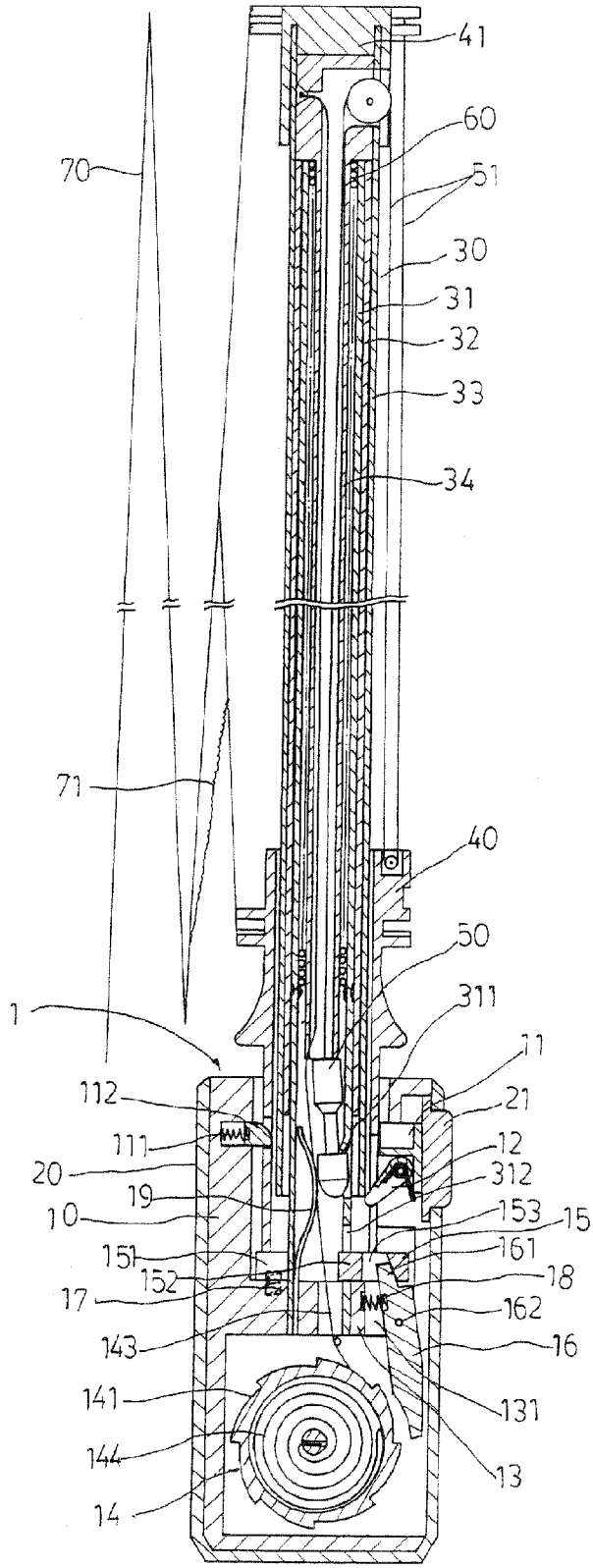
FIG. 2 is a sectional diagrams showing the control structure of FIG. 1 when the umbrella is folded.

As shown in FIGS. 1 and 2, a control structure 1 for an automatically folded and unfolded umbrella according an embodiment of the present invention is installed in a handle 20 of a 3-fold umbrella. The umbrella also contains a shaft 30, a nest 40, a bullet head 50, an opening spring 60, and ribs 70. A push button 21 is configured on the circumference of the handle 20. The shaft 30 contains a first tube 31, a second tube 32, and a third tube 33, telescoped together. A bottom end of the first tube 31 is fixedly joined to the control structure 1 in the handle 20 and a curved piece 19 is housed in the first tube 31. An upper slot 311 and a bottom slot 312 are configured on the circumference of the first tube 31. The third tube 33 is threaded through the nest 40 having a notch 401 aligned with the push button 21 along a bottom section of the nest 40. An upper nest 41 is fixedly joined to an upper end of the third tube 33 and the ribs 70 are configured between the nest 40 and the upper nest 41. A bottom end of the upper nest 41 is fixedly joined to an inner tube 34 of the shaft 30. The opening spring 60 is configured between the first tube 31 and the inner tube 34. The bullet head 50 is configured beneath the inner tube 34 and is connected to a pulling string 51 which runs through the inner tube 34, over a pulley of the upper nest 41, around another pulley of the nest 40, and then connects back to the upper nest 41.

The control structure 1 mainly contains a main body 10 whose upper and lower halves are hollow with a support base 13 in the middle. A control piece 11 is installed in the upper hollow space. A control rod 12 is configured adjacent to a front side facing the push button 21 and below the control piece 11. On the other hand, a block 112 is configured inside the control piece 11 at a back side opposite to the control rod 12. A small spring 111 outside the control piece 11 adjacent to the block 112 pushes the control piece 11 towards the push button 21. A notch 131 is formed on a front side of the support base 13. A lever 16 is pivotally housed in the notch 131 by a pin 162. The lever 16 has a slant block 161 at a top end and a spring 18 inside the notch 131 pushes the lever 16 so that its bottom end tilted backward. An actuating piece 15 is configured on top of the lever 16. The actuating piece 15 has two arms 151 extended backward and a T-shaped positioning block 152 is configured between the arms 151. The actuating piece 15 further has a through opening 153 in front of positioning block 152 and above the slant block 161. The opening 153 has a slant inner surface corresponding to the slant block 161. The actuating piece 15 has the positioning block 152 plugged into the lower slot 132 of the first tube 31 and the actuating piece 15 is able to slide up and down along the first tube 31 as such. Two small springs 17 are configured on the support base 13 beneath the arms 151 of the actuating piece 15 so as to raise the actuating piece 15. In the lower hollow space of the main body 10, a one-way wheel 14 with a winding spring 144 inside is pivotally installed. Ratchets 141 are provided on the circumferential surface of the one-way wheel 14 and could be engaged by the bottom end of the lever 16. On a right half of the circumferential surface, a wire groove 143 is provided from which a safety string 143 is connected to the upper nest 41 through the main body 10.

As shown in FIG. 2 where the umbrella is closed and folded, the control rod 12 is not engaged due to the notch 401 of the nest 40. However, the arms 151 of the actuating piece 15 are pushed downward by the nest 40 so that the slant block 161 of the lever 16 is threaded into the through opening 153. As their slant surfaces interact, the lever 16 is moved away from the ratchets 141 of the one-way wheel 14. In the mean time, the nest 40 is engaged by the block 112 of the control piece 11 and thereby positioned. The control rod 12 on the other hand is pushed and tilted by the third tube 33, and the bullet head 50 is pushed by the first tube 31 and the curve piece 19 to be locked to the upper slot 311 of the first tube 31. At the moment, the winding spring 144 inside the one-way wheel 14 is completely relaxed and most of the safety string 143 are collected and wound around the wire groove 142.

Figure 3:
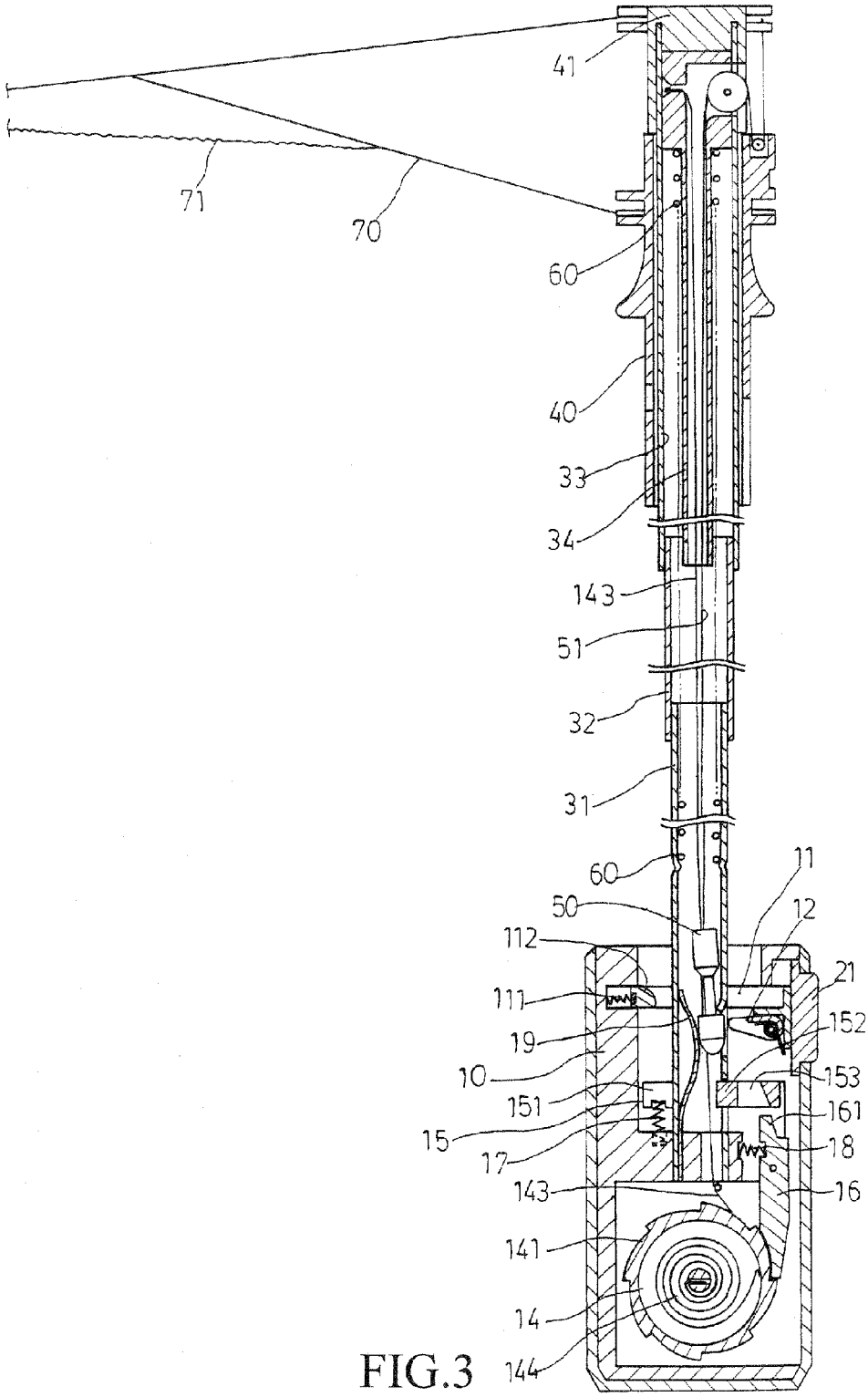
FIG. 3 is a sectional diagrams showing the control structure of FIG. 1 when the umbrella is unfolded.

As shown in FIG. 3, when the push button 21 is pressed to open the umbrella, the control piece 11 is pushed inward and the block 112 breaks away from the nest 40. By the opening spring 60 inside the shaft 30, the nest 40 and the various tubes of the shaft 30 are extended upward, and the ribs 70 are expanded and unfolded. In the mean time, the control rod 112 is restored to a level state and touches the bullet head 50. The safety string 143 is pulled upward along with the upper nest 41 and the one-way wheel 14 is turned counterclockwise to tighten the winding spring 144. At the moment, the actuating piece 15, without the nest 40's pressing and under the action of the springs 17, is raised upward so that the lever 16 escapes the confinement of the opening 153 of the actuating piece 15. Then, by the expansion of the spring 18, the lever 16's bottom end is moved to engage the ratchets 141 of the one-way wheel 14.

Figure 4:
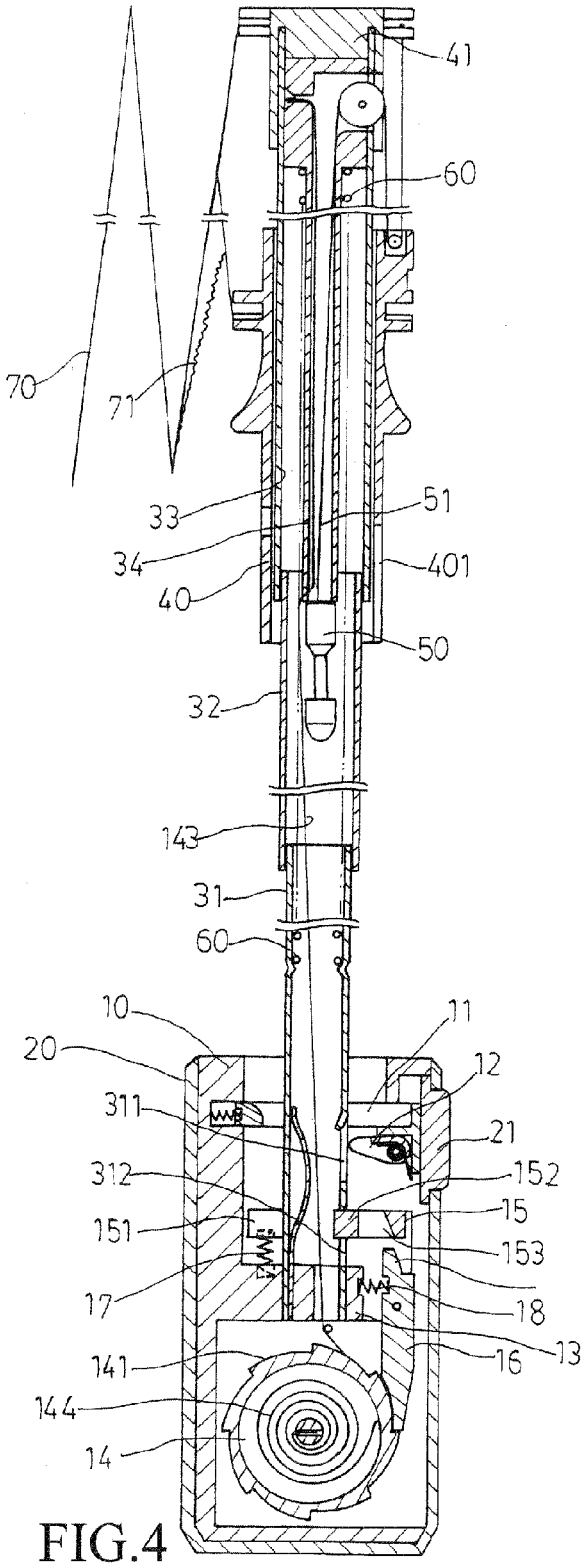
FIG. 4 is a sectional diagram showing the interior of the umbrella shaft when the umbrella is folded.

As shown in FIG. 4, when the push button 21 is pressed again to close the umbrella, the control rod 12 pushes the bullet head 50 so that the bullet head 50 escapes the locking by the first tube 31 of the shaft 30. Then, under the driving of a number of closing springs 71 of the umbrella's ribs 70, the ribs 70, together with the attached fabric, are folded and the nest 40 is pushed downward. Through the pulling string 51, the bullet head 50 is pulled upward to a bottom end of the inner tube 34. Then, the shaft 30 is compressed and the safety string 143 is released. The one-way wheel 14 is turned clockwise by the expansion of the winding spring 144. The lever 16 as such would be pushed away. However, under the action of the spring 18, the lever 16 could be restored to engage the ratchets 141 of the one-way wheel 14 any time. Consequently, whenever there is some mishap during the closing of the umbrella, the one-way wheel 14 would be turned in an opposite direction and its ratchets 141 would be immediately engaged by the lever 16. As the one-way wheel 14 is stopped, the upper nest 41 is held by the safety string 143 linked to the one-way wheel 14. The shaft 30 under compression is then locked and prevented from being thrust open by the opening spring 60. When the umbrella is successfully closed, the configuration would be identical what is depicted in FIG. 2.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A control structure for an automatically folding and unfolding umbrella, said control structure being installed in a handle of said umbrella and fixedly joined to a bottom end of a first tube of a shaft of said umbrella, said control structure comprising:

a main body whose upper and lower halves are hollow and a support base is configured in the middle;

a control piece installed in said upper hollow space;

a lever pivotally configured on said support base;

an actuating piece configured above said lever, said actuating piece having two arms extended backward, a T-shaped positioning block being configured between said arms, said actuating piece further having a through opening in front of said positioning block and above a slant block, said opening having a slant inner surface corresponding to said slant block; and a one-way wheel installed inside said lower hollow space, said one-way wheel having circumferential ratchets and a wire groove where a safety string is wound;

wherein, when said umbrella is closed, said lever is prepared to engage said ratchets in case some mishap occurs; and, when said umbrella is successfully closed, said actuating piece engages said lever so that said lever is moved away from said ratchets and that said umbrella could be smoothly opened subsequently.

2. The control structure according to claim 1, wherein a control rod is configured to a front side facing a push button of said handle and below said control piece; and a block is configured inside said control piece at a back side opposite to said control rod.

3. The control structure according to claim 1, wherein a notch is formed on a front side of said support base; said lever is pivotally housed in said notch by a pin; said lever has a slant block at a top end; and a spring inside said notch pushes said lever so that said lever's bottom end tilted backward.

4. The control structure according to claim 1, wherein a winding spring is configured inside said one-way wheel; and said safety string has an end connected to an upper nest of said umbrella through said main body.

5. The control structure according to claim 4, wherein said shaft contains said first tube, a second tube, and a third tube, telescoped together; an upper slot and a bottom slot are configured on the circumference of said first tube; said positioning block is plugged into said lower slot of said first tube; and said actuating piece is able to slide up and down along said first tube accordingly.

6. The control structure according to claim 1, wherein said umbrella contains said shaft, a nest, a bullet head, an opening spring, and ribs; a push button is configured on the circumference of said handle; said shaft contains said first tube, a second tube, and a third tube, telescoped together; a curved piece is housed in said first tube; said third tube is threaded through said nest; an upper nest is fixedly joined to an upper end of said third tube; said ribs are configured between said nest and said upper nest; a bottom end of said upper nest is fixedly joined to an inner tube of said shaft; said opening spring is configured between said first tube and said inner tube; said bullet head is configured beneath said inner tube and is connected to a pulling string which runs through said inner tube, over a pulley of said upper nest, around another pulley of said nest, and then connects back to said upper nest; and said nest has a notch aligned with said push button along a bottom section of said nest.

* * * * *